United States Patent [19]

Stegherr

[11] Patent Number: 4,541,466

[45] Date of Patent: Sep. 17, 1985

[54] METHOD AND APPARATUS FOR MACHINING, PREFERABLY MILLING OR GRINDING OF EDGES AND ROUNDINGS OF WORKPIECES IN A SINGLE MACHINE CYCLE

[76] Inventor: Ludolf Stegherr, Donaustaufer Strasse 30, Regensburg, Fed. Rep. of Germany

[21] Appl. No.: 269,905

[22] Filed: Jun. 3, 1981

[30] Foreign Application Priority Data

Jun. 6, 1980 [DE] Fed. Rep. of Germany ..... 3021359

[51] Int. Cl.[4] ..... B27B 1/00

[52] U.S. Cl. ..... 144/363; 51/283 E; 83/733; 144/134 A; 144/137; 409/97; 409/123

[58] Field of Search ..... 51/283 E; 83/411 R, 83/452, 733; 144/134 R, 134 A, 137, 138, 139, 145 R, 145 A, 363; 409/97, 103, 104, 111, 112, 122, 123

[56] References Cited

U.S. PATENT DOCUMENTS

| | | | |
|---|---|---|---|
| 1,686,773 | 10/1928 | Shaw | 144/134 R |
| 2,722,957 | 11/1955 | Marvosh | 144/134 A |
| 3,995,521 | 12/1976 | Raphael | 83/733 |
| 4,215,732 | 8/1980 | Novinger | 144/145 A |
| 4,241,771 | 12/1980 | Rhodes et al. | 144/145 A |
| 4,244,253 | 1/1981 | Flanigan | 144/134 A |
| 4,450,882 | 5/1984 | Hitchcock et al. | 144/145 A |

*Primary Examiner*—W. D. Bray

*Attorney, Agent, or Firm*—Sandler & Greenblum

[57] ABSTRACT

A bevel and radius routing machine is disclosed with which edges are shaped and corners are rounded in a single machine cycle and which does not require any templates. The radii to be machined can be infinitely variable between 0 and 100 mm by means of simple work spindle adjustment, and no resetting of machine is required when workpiece dimensions are changed. The workpieces to be machined are made from wood, artificial wood, wood substitutes or the like. With the apparatus according to this invention the workpiece is fed past the cutter by means of rubber coated feed rollers and as soon as the position is reached at which the radius begins is swivelled through 90° and then traversed to the next radius in a straight line.

9 Claims, 6 Drawing Figures

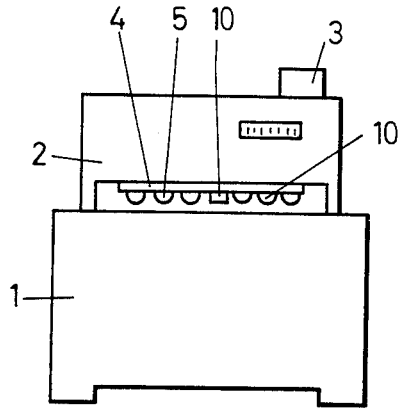
Fig.1
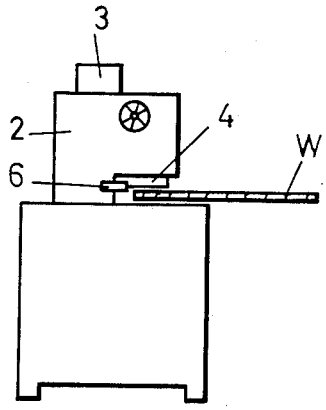
Fig.2
Fig.3
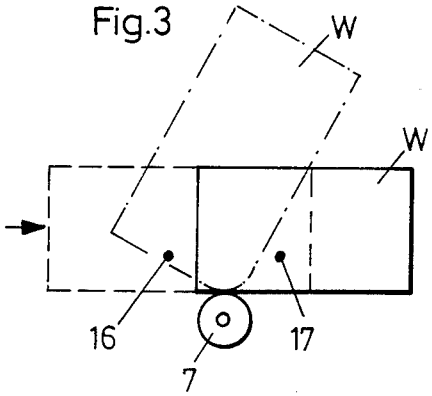
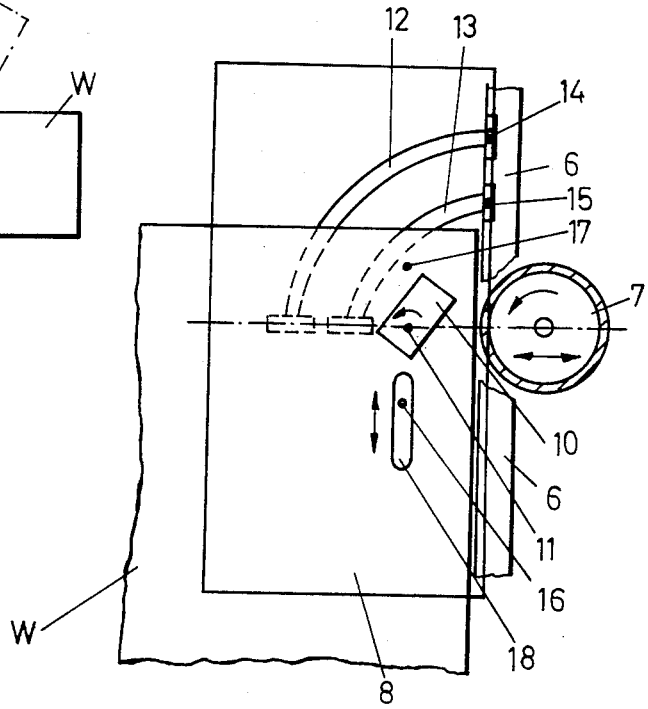
Fig.4

Fig. 5
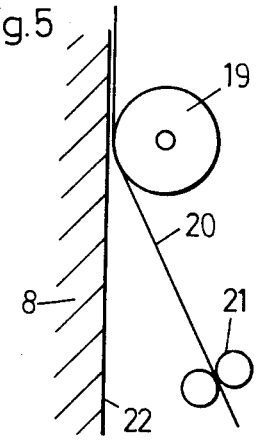
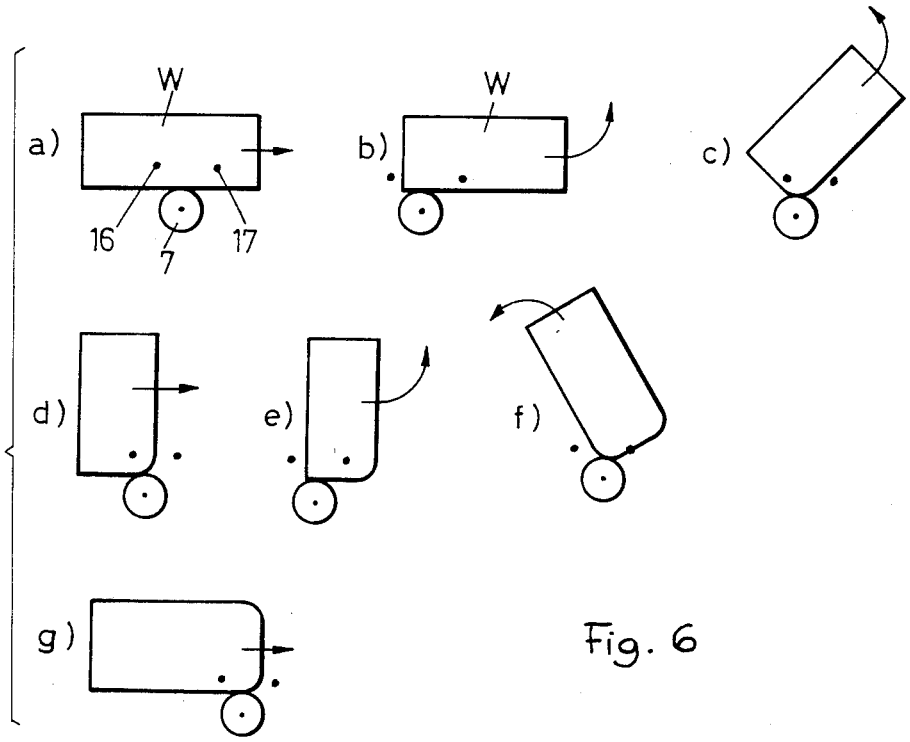
Fig. 6

METHOD AND APPARATUS FOR MACHINING, PREFERABLY MILLING OR GRINDING OF EDGES AND ROUNDINGS OF WORKPIECES IN A SINGLE MACHINE CYCLE

BACKGROUND OF THE INVENTION

This invention refers to a method and an apparatus for machining, especially milling or grinding of profiles, edges, roundings and the like of workpieces made from wood, e.g. table tops, furniture elements etc.

Shaping edges and rounding corners of a polygonal workpiece, such as, for example, table tops, furniture elements and the like, generally is done using a template that is followed by a cutting tool. Each profile or alternatively each different corner radius requires a special template; and when changing from one profile to another profile, or alternatively from one rounding to another rounding with different radii, a change of templates is necessary. On the one hand, this change of templates requires considerable time, and on the other hand, requires making and storing a plurality of templates according to the selection of required profiles or roundings causes considerable expenses.

SUMMARY OF THE INVENTION

It is an object of this invention to obtain automatic machining preferably shaping the edges and rounding the corners from wooden workpieces in a single machine cycle throughout the entire periphery of the workpiece without using any templates. According to this invention this is obtained by a method with the following steps:

According to the present invention, the edges of a polygonal workpiece are shaped by moving the workpiece in a first longitudinal direction while a tool is engaged with the workpiece for shaping a longitudinal edge thereof, stopping longitudinal movement of the workpiece after the latter reaches a predetermined position at which the tool engages the workpiece where a corner is to commence, rotating the workpiece about an axis perpendicular to the longitudinal direction while the tool remains engaged with the workpiece thereby rounding the corner, and then repeating these steps until all of the edges of the workpiece have been shaped and all of the corners thereof have been rounded.

Apparatus according to the present invention includes a table for supporting the workpiece, a tool operatively engageable with an edge of the workpiece when the latter is supported on the table, and a feed device selectively operable for displacing the workpiece on the table in a first longitudinal direction when the tool is engaged with the workpiece whereby a longitudinal edge thereof is shaped by the tool. The apparatus also includes clamp means selectively operable for rotating the workpiece about an axis perpendicular to the longitudinal direction when the tool is engaged with the workpiece whereby a corner of the workpiece is rounded.

Making use of this invention results in the fact that on one and the same workpiece edges will be shaped and corners will be rounded simultaneously in a single machine cycle and that the necessity for templates to be made for the special purposes can be avoided. The roundings can be made in a wide range of practically $r=0$ up to large radii of $r=100$ mm and more, for example, by infinitely varying the distance between the pressure member and the tool simply by adjusting the spindle. The edge profiles can be chosen at will by using different machining tools, for example, cutters. The apparatus according to this invention and the machine using this apparatus is not bound to workpiece dimensions, because additional supports are able to take up any size of workpiece for the machining operation. Furthermore, the shape of the workpiece to be machined is not relevant. As well square as rectangular as polygonal shapes of workpieces can be machined in the same manner. If, for example, a hexagonal-shaped workpiece is to be machined the stepwise rotation of the workpiece will be 60° each, whereby the periphery of the hexagon is continuously machined in one cycle and without any additional adjustment or change of the machine.

It is most important for this invention that the workpiece for machining, for example, profile milling of the straight-line faces is moved past the tool (cutter), for example, by means of rubber coated feeding rollers which are arranged slightly inclined towards the stop ledge and that when reaching the position at which the chosen rounding begins without any interruption the workpiece is pressed against a rotational or pressing member or the like which will be rotated over a required angle corresponding to the radius to be machined, whereby the workpiece and the rotational or pressing member move synchronously with each other, that at the position at which this rounding joins the following straight-line of the workpiece the latter is released and is moved past the tool in a longitudinal direction so that this face edge is machined, that subsequent thereto the next-following rounding is machined by fixing and rotating the workpiece again by means of the rotational and pressing member, and so forth. Dimensional differences of the workpieces do not require any resetting of the machine and are of no disadvantage for the result of the machining operation.

Instead of machining or alternatively routing bevels, profiles and roundings or workpieces the method and apparatus according to this invention also can be used for continuously applying adhesive tapes or strips to the periphery of workpieces. Feeding and applying adhesive is made by using adhesive applying rollers in a manner known per se. The cutter is substituted by a pressure roller which unrolls on the pressure roller (usually over 360°) similar to the unrolling of the workpiece on the tool similar to the above described manner.

BRIEF DESCRIPTION OF THE DRAWINGS

Embodiments of the present invention are shown in the accompanying drawing wherein:

FIG. 1 is a schematic representation of the front view of one form of the apparatus according to the invention for a bevel and radius routing machine;

FIG. 2 is a side view of the apparatus and machine shown in FIG. 1;

FIG. 3 is a representation of the principle of the operation mode of the apparatus according to this invention;

FIG. 4 is a plan view of part of the working table of the machine according to this invention;

FIG. 5 is another form of the machine according to the invention for applying adhesive tapes or the like, and FIG. 6 is a diagrammatic representation of various steps of the operation of machining a rectangular workpiece.

DESCRIPTION OF THE PREFERRED EMBODIMENT

Refering now to FIG. 1 of the drawing, machining device 2 is mounted on machine frame 1 which has a suction channel 3 for removing dust caused during operation. The machining device 2 is provided with a feeding device 4 having feeding rollers 5 which transport the workpiece through the machine in a first longitudinal direction. The feeding rollers 5 preferably are arranged slightly inclined in the direction of movement of the workpiece W so that the tool is urged against stop or guide ledges 6 of the machine. These ledges 6, 6 are correlated to the machining tool 7, for example, a cutter. Cutter 7 and ledges 6 are adjustable in common transverse to the direction of movement of the workpiece; preferably, the ledges 6 are adjustable independent from the tool 7.

In feeding the workpiece W into the machine, a longitudinal straight edge of the workpiece W, which is to be shaped, is pressed against the stop or guide leges 6, 6 by means of the feeding rollers 5. Before the trailing end of the workpiece W separates from cutter 7 the workpiece 7 is rotated on the working table 8 so that a corner of the workpiece W is rounded. Subsequent thereto the next adjacent edge of the workpiece is machined, and following that, the workpiece is turned again, whereby the next corner is rounded, and so on, until all four edges of the workpiece and all four corners are rounded. The machining step is performed continuously, and there is an uninterrupted engagement between the cutter and the workpiece, which, if it is of rectangular shape, is rotated four times 90° each.

The workpiece W is fixed for independent movement relative to the cutter 7 for performing a rotational movement thus permitting the corners of the workpiece to be rounded. Fixing the workpiece W is done by means of a movable clamping member 10 in a mechanical, hydraulic or pneumatic manner. The clamping member 10 is pressed against the workpiece W, as soon as the latter has reached that position at which the rotational movement of the workpiece is to take place, namely at the position at which the cutter is engaged with the workpiece where a corner is to commence. To permit rotation to take place, the feeding device 4 with the feeding rollers if lifted, the pressure member 10 is moved against the workpiece W and is rotated around its own vertical rotational axis 11 so that the workpiece rotates relative to the cutter. Rotating the workpiece W is performed by sliding pusher plate means 14, 15 guided within arcuate tracks 12, 13. These pusher plates press against a lateral face of the workpiece W causing it to rotate when it is fixedly arranged by the pressure member 10. Usually, the pressure member need not be self-powered, and the rotational movement is caused by the driven pusher plates 14, 15. The pressure member 10 merely supports the workpiece and conforms the rotational movement by the bolts.

Drive control means are correlated to the pressure member 10 and rollers 5 and are formed as two control nozzles 16, 17 arranged within the working table 8; one of the nozzles is arranged in front of the pressure member 10 (in direction of movement) and the other nozzle is arranged behind the pressure member (in direction of movement). Correlation of these control nozzles 16, 17 relative to the pressure member 10 is chosen in such a manner that if the trailing edge of the passing workpiece W uncovers the nozzle 16, a command for rotating the workpiece W is given, whereas if the nozzle 17 is uncovered by the workpiece, which means that the next face edge is to be machined, the rotation is stopped and the rollers 5 are commanded to resume operation. Movement of the workpiece resumes in a straight-line with simultaneously machining said face.

The tool 7 is adjustable transverse to the direction of movement of the workpiece W. Together with tool 7 the ledges 6, 6 are adjusted so that by adjusting the combination of ledges 6 and tool 7 the radius of the corner to be machined can be adjusted. This adjustment is made infinitely variable so that also an infinitely variable change of the radius of the rounding will be obtained. Simultaneously with altering the distance between cutter 7 and axis 11 of the clamping member 10, a positional adjustment of the control nozzle 16 is required, because the distance between axis 11 and point of engagement of the tool 7 is to be identical with the distance between axis 11 and nozzle 16, if the time delay for carrying through the control operation is not considered. Therefore, it is preferable to adjust tool 7 and nozzle 16 simultaneously and in common so that movement of both the cutter 7 and nozzle 16 is correlated. The nozzle 16 preferably is arranged within a slot of the working table 8 in the direction of movement of the workpiece or in an opposite direction, whereby tool 7 and nozzle 16 can be connected with each other by tie rods in order to obtain an adjustment in unison.

According to the variation of FIG. 5 which corresponds to the embodiment of FIG. 4 instead of the cutter 7 a pressure roller 19 is used which presses an adhesive tape 20 against the face 22 of the workpiece W; the adhesive tape 20 is fed through adhesive applying means 21. No further alterations of the apparatus according to the invention or concerning the movement of the workpiece is required.

I claim:

1. Apparatus for shaping the edges of a workpiece comprising (a) a table for supporting the workpiece;

(b) a tool operatively engageable with an edge of the workpiece when the latter is supported on the table;

(c) a feed device selectively operable for displacing the workpiece on the table in a first longitudinal direction when the tool is engaged with the workpiece whereby a longitudinal edge thereof is shaped by the tool;

(d) clamp means selectively operable for rotating the workpiece about an axis perpendicular to the longitudinal direction when the tool is engaged therewith whereby a corner of the workpiece is rounded; and (e) position sensing means responsive to the position of the workpiece on the table for selectively operating the feed device and the clamp means such that the tool shapes a longitudinal edge of the workpiece when the feed device is operated and rounds a corner of the workpiece when the clamp means is operated.

2. Apparatus according to claim 1 wherein the position sensing means includes a pair of sensors operatively associated with the workpiece, each sensor having one state when the workpiece is sensed and an opposite state when the workpiece is not sensed, said position sensing means operating said feed device when the sensors have like states, and operating the clamp means when the sensors have opposite states.

3. Apparatus according to claim 1 wherein the feed device includes rollers that are powered for displacing the workpiece in said first longitudinal direction.

4. Apparatus according to claim 3 wherein the rollers are selectively engageable with the workpiece only until the latter reaches a predetermined position on the table.

5. Apparatus according to claim 1 wherein the clamp means includes a pressure member that moves into engagement with the workpiece only after the latter reaches said predetermined position on the table.

6. Apparatus according to claim 5 wherein the clamp means includes a pusher plate engageable with an edge of the workpiece when the latter reaches said predetermined position on the table, and rotatable about an axis perpendicular to said longitudinal direction.

7. Apparatus according to claim 5 wherein the pusher plates rotate through about 90°.

8. A method for shaping the edges of a polygonal workpiece comprising:

(a) moving the workpiece in a first longitudinal direction while a tool is engaged with the workpiece for shaping a longitudinal edge thereof;

(b) stopping longitudinal movement of the workpiece after the latter reaches a predetermined position at which the tool engages the workpiece where a corner is to commence;

(c) rotating the workpiece about an axis perpendicular to the longitudinal direction while the tool remains engaged with the workpiece thereby rounding the corner; and (d) repeating steps (a), (b), and (c) until all of the edges of the work piece have been shaped and all of the corners thereof have been rounded.

9. A method according to claim 8 wherein the tool is rotatable and the axis about which the workpiece is rotated is parallel to the axis of rotation of the tool.

* * * * *